US006712241B1

(12) United States Patent
Garcia et al.

(10) Patent No.: US 6,712,241 B1
(45) Date of Patent: Mar. 30, 2004

(54) FLEXIBLE-POUCH SUPPORT AND DISPENSER CONTAINING SAID SUPPORT

(75) Inventors: Firmin Garcia, Evreux (FR); Laurent Decottignies, Cergy (FR); Christian Campfort, Nogent-le-Roi (FR)

(73) Assignee: Airlessystems, Charleval (FR)

( * ) Notice: Subject to any disclaimer, the term of this patent is extended or adjusted under 35 U.S.C. 154(b) by 0 days.

(21) Appl. No.: 09/958,926

(22) PCT Filed: Apr. 19, 2000

(86) PCT No.: PCT/FR00/01017

§ 371 (c)(1),
(2), (4) Date: Jan. 8, 2002

(87) PCT Pub. No.: WO00/63093

PCT Pub. Date: Oct. 26, 2000

(30) Foreign Application Priority Data

Apr. 20, 1999 (FR) ..... 99 04979

(51) Int. Cl.[7] ..... B65D 35/08
(52) U.S. Cl. ..... 222/107; 222/92; 222/105
(58) Field of Search ..... 222/92, 105, 107, 222/95

(56) References Cited

U.S. PATENT DOCUMENTS 5,147,071 A * 9/1992 Rutter et al. ..... 222/92

* cited by examiner

*Primary Examiner*—Gene Mancene
*Assistant Examiner*—Melvin Cartagena
(74) *Attorney, Agent, or Firm*—Sughrue Mion, PLLC

(57) ABSTRACT

A support (1) for a flexible pouch for a fluid dispenser, said support comprising an appendage (11) to which the flexible pouch is fixed via its opening, and a socket (12) on which a dispensing member such as a pump is mounted, said support defining a passageway (13) causing the dispensing member to communicate with the flexible pouch so as to enable fluid contained in the pouch to be extracted by the dispensing member, said support being characterized in that said support (1) is provided with at least one tube (2) defining an internal duct (20) open at both ends of the tube, said tube (2) being fixed to the support (1) so that it has a free end (21) extending inside the flexible pouch, while its "top" other end (22) is fixed to the support eccentrically relative to the passageway (13) so that it causes the internal duct (20) to communicate with said passageway (13).

8 Claims, 2 Drawing Sheets

FEUILLE MODIFI E

FLEXIBLE-POUCH SUPPORT AND DISPENSER CONTAINING SAID SUPPORT

The present invention relates to a support for a flexible pouch, such a support serving to be mounted in a fluid dispenser including a flexible pouch in which a fluid to be dispensed is stored. To extract the fluid from the flexible pouch fixed to the support, a dispensing device is provided such as a pump or a valve. The dispensing device is preferably a device of the "airless" type in which the fluid is extracted without air being taken in, so that the volume of the flexible pouch decreases as the fluid is dispensed.

In that type of dispenser, it is known that an intermediate part can be used for forming the connection between the dispensing device and the flexible pouch. Such an intermediate part is referred to herein is a "flexible pouch support" because it is to said part that the opening in the flexible pouch is fixed, in general by heat-sealing. Furthermore, the support defines a structure on which the dispensing device or dispensing member is mounted. The support then defines a passageway that causes the dispensing member to communicate with the opening in the flexible pouch so as to enable fluid contained in the pouch to be extracted therefrom.

A problem that arises with that type of pouch dispenser lies in the fact that the pouch becomes flattened, thereby sometimes forming compartments from which the fluid cannot be extracted. As a result, a certain quantity of fluid cannot be dispensed because it remains captive in said compartments, and fluid is therefore wasted.

The dispenser described in Document WO 93/25321 includes a flexible pouch that is provided with a dip tube fixed in a connection sleeve which also defines the passageway that causes the inside of the pouch to communicate with the outside. The fluid can thus reach the passageway in the support either directly along the tube or else via the inside of the tube, in the event that a compartment forms in the pouch. The tube thus has a drawing-off function enabling the fluid contained in a compartment of the pouch to be extracted therefrom.

The same applies in Document U.S. Pat. No. 5,190,184. In short, the tube is disposed directly in the passageway.

The drawback with that type of dispenser is that it is difficult to fill the pouch with fluid since the tube is disposed in the passageway via which the inside of the pouch is caused to communicate with the outside. It is thus impossible to insert the nozzle of the filling apparatus into the flexible pouch, as is the common procedure.

An object of the present invention is to remedy that drawback of the prior art by defining a dispenser that is of the type having a pouch and a dip tube but that is easy to fill.

To this end, the present invention provides a support for a flexible pouch as defined in claim 1. By placing the dip tube outside the passageway, the design reverts to being fully conventional in that filling is performed normally with the nozzle in the passageway. The dip tube leaves the passageway totally unobstructed.

Advantageously, said appendage is provided with at least one fixing end-piece suitable for coming into engagement with the top end of the tube. Preferably, said fixing end-piece communicates with the passageway via at least one window that is situated beyond the top end of the tube. In a variant, said fixing end-piece communicates with the passageway via a duct extending in line with said end-piece and opening out in the passageway. In one embodiment, the top end of the tube is engaged by force over said end-piece. Preferably, said at least one tube is fixed with its top end outside the passageway and in the direct vicinity thereof.

The invention also provides a fluid dispenser including a such a support.

The invention is described more fully below with reference to the accompanying drawings which give an embodiment of the present invention by way of non-limiting example.

In the drawings:

FIG. 1*a* is a section view through a support of the invention for a flexible pouch;

FIG. 1*b* is a variant embodiment of FIG. 1*a;*

FIG. 3 is a vertical section view offset by 90° relative to the view of FIG. 1*a.

Figure 1A:
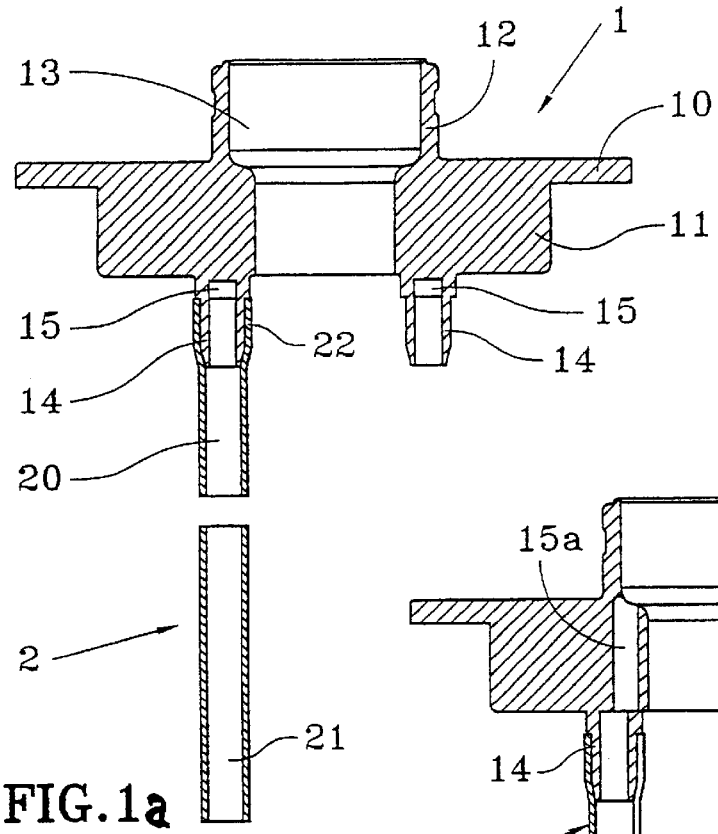
Figure 2:
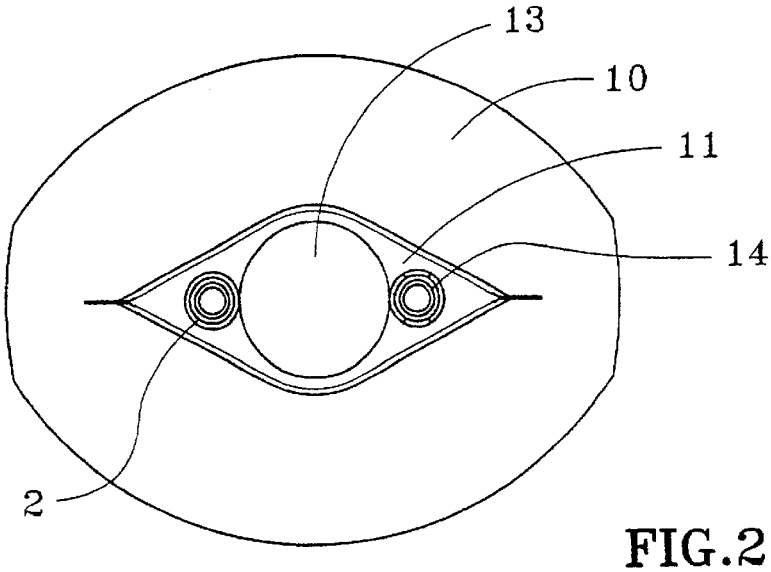
FIG. 2 is a view from underneath the pouch support of FIG. 1*a;*
Figure 3:
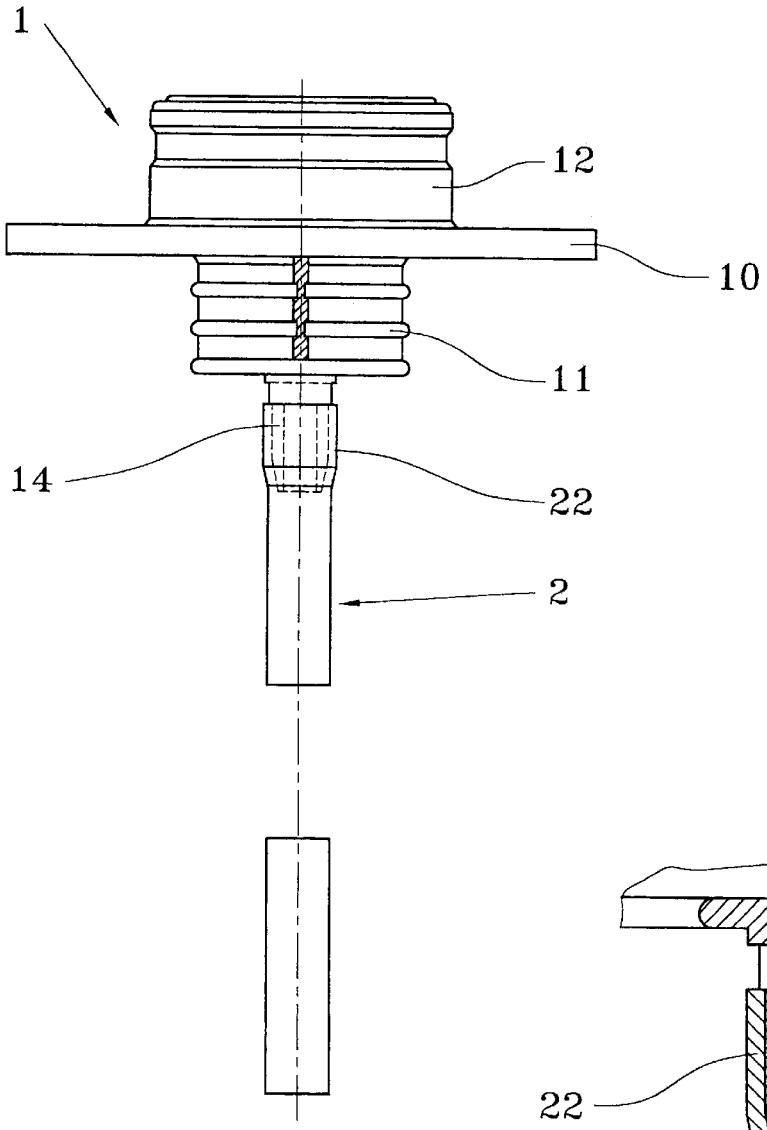
Figure 4:
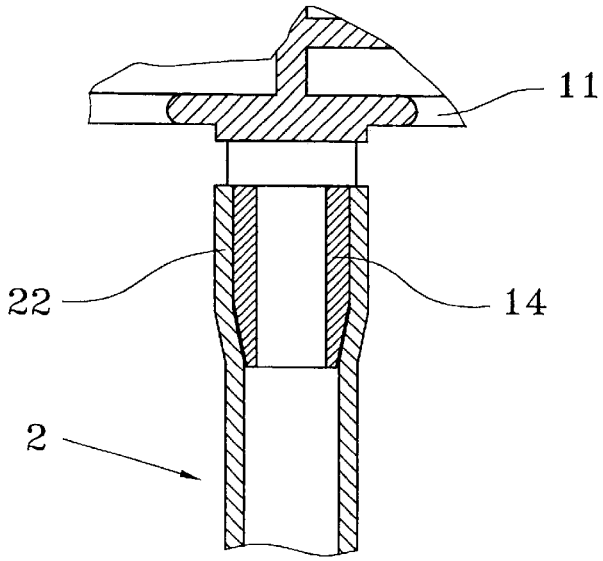
* and FIG. 4 is an enlargement of a detail of FIG. 3.

The support of the invention for a flexible pouch is given overall numerical reference 1, and it is preferably made by molding a plastics material. It essentially comprises an appendage 11 which is advantageously diamond shaped or eye-shaped as can be seen in FIG. 2, and to which the opening in the flexible pouch (not shown) can be fixed, e.g. by heat-sealing. To facilitate and to improve the quality of the leaktight fixing whereby the flexible pouch is fixed to the appendage 11, said appendage may be provided with horizontal ribs, as can be seen in FIG. 3. In addition, the flexible pouch support 1 is provided with a socket 12 serving to receive a pump or a valve. For example, the pump may be fixed to the socket 12 by means of a ring suitable for snap-fastening to the socket 12 while holding the pump or the valve against the socket. The support 1 defines a passageway 13 extending through the socket 12 and through the appendage 11 as can be seen in FIG. 1*a*. The passageway makes it possible to cause the inlet of the pump or of the valve mounted on the socket 12 to communicate with the opening in the flexible pouch, which opening is heat-sealed to the appendage 11. Furthermore, the support 1 may be provided with a peripheral flange 10 that can serve for fixing the support to a rigid shell enclosing the flexible pouch.

Figure 1B:
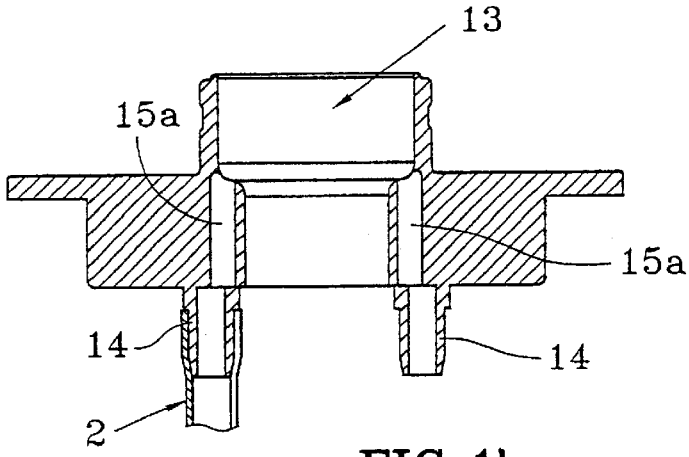

The support 1 is provided with a tube 2 designed to extend inside the flexible pouch. The tube 2 is open at both of its ends and, internally, it defines a duct 20 through which the fluid can flow. In this example, the tube 2 has a bottom end 21 situated inside the flexible pouch, preferably in the vicinity of the end wall of the pouch, and a top end 22 connected to the support 1. The duct 20 communicates with the passageway 13 directly or indirectly without any possibility of the pouch interrupting or closing off this communication. In the invention, the tube 2 extends eccentrically relative to the passageway 13, so that it is situated outside the passageway, thereby leaving said passageway totally unobstructed for the purpose of filling the pouch. The tube 2 is fixed to the support 1 at the appendage 11 over an end-piece 14 formed in the vicinity of the bottom opening of the passageway 13. The end-piece 14 is in the form of a connection sleeve over which the top end 22 of the tube 2 can be engaged, e.g. by force, and said end-piece is further provided with one or more windows 15 situated above the top end 22 of the tube 2, said window(s) communicating directly or indirectly with the passageway 13. In a variant shown in FIG. 1*b,* the sleeve 14 of the fixing end-piece may communicate with the passageway 13 via a duct 15*a* that extends in line with said sleeve and opens out into the side of the passageway 13.

The mode of fixing used to fix the tube to the support 1 is not critical for the invention in that any fixing technique may be used to secure the tube 2 to the support 1. Consideration may even be given to a version in which the support 1 and the tube 2 are integrally molded.

The spirit of the invention lies in the use of a tube that communicates with the passageway 13 without it being possible for the flexible pouch to interrupt this communication, so that the bottom end 21 of the tube 2 can reach the zones of the pouch in which sealed-off compartments can form. In addition, the tube must not impede or clutter the passageway 1 for filling the pouch.

It is possible, while remaining within the ambit of the invention, to consider a flexible pouch support that is provided with a plurality of tubes 2, as can be seen in the figures, in which two fixing end-pieces are provided on the same pouch support 1, situated on either side of the passageway.

The fluid contained in the flexible pouch can thus reach the passageway 13, either directly, e.g. along the tube 2, or indirectly through the tube 2, which communicates via its top end 22 with the passageway 13.

What is claimed is:

1. A support (1) for a flexible pouch for a fluid dispenser, said support compromising an appendage (11) to which the flexible pouch is fixed via its opening, and a socket (12) on which a dispensing member such as a pump is mounted, said support defining a passageway (13) causing the dispensing member to communicate with the flexible pouch so as to enable fluid contained in the pouch to be extracted by the dispensing member, said support being characterized in that said support (1) is provided with at least one tube (2) defining an internal duct (20) open at both ends of the tube, said tube (2) extending freely inside the pouch and being fixed to the support (1) so that is has a free end (21) extending inside the flexible pouch, while the other top end (22) is fixed to the support inside the pouch eccentrically relative to the passageway (13) with the internal duct (20) communicating with said passageway (13).

2. A support according to claim 1, in which said appendage (11) is provided with at least one fixing end-piece (14) suitable for coming into engagement with the top end (22) of the tube (2).

3. A support according to claim 2, in which said fixing end-piece communicates with the passageway (13) via at least one window (15) that is situated beyond the top end (22) of the tube (2).

4. A support according to claim 2, in which the tope end (22) of the tube (2) is engaged by force over said end-piece (14).

5. The support according to claim 2, further comprising a second fixing end-piece that communicates with the passageway via a second window and that is configured to be engage with the top end of the tube.

6. A support according to claim 1, in which said fixing end-piece (14) communicates with the passageway via a duct **(15*a*) extending in line with said end-piece and opening out in the passageway (13)**.

7. A support according to claim 1, in which said at least one tube (2) is fixed with its top end (22) outside the passageway (13) and in the direct vicinity thereof.

8. A fluid dispenser including a flexible pouch and a support (1) according to claim 1.

* * * * *